United States Patent [19]

Queffelec et al.

[11] 4,388,785

[45] Jun. 21, 1983

[54] COOLING TOWERS

[75] Inventors: Corentin Queffelec, Sceaux; Rene Bordet, Courbevoie; Marc Malinowsky, Verrieres-Le-Buisson, all of France

[73] Assignee: Electricite de France (Service National), Paris, France; by said Rene Bordet

[21] Appl. No.: 171,157

[22] Filed: Jul. 22, 1980

[30] Foreign Application Priority Data

Jul. 24, 1979 [FR] France ..... 79 19000

[51] Int. Cl.[3] ..... E04B 1/32; E04B 1/00; E04C 3/26

[52] U.S. Cl. ..... 52/222; 52/81; 52/173 R; 52/245; 52/745; 52/825

[58] Field of Search ..... 52/81, 222, 173 R, 245, 52/825, 830; 261/DIG. 11; 160/392, 395, 378; 98/58, 745

[56] References Cited

U.S. PATENT DOCUMENTS

| | | | |
|---|---|---|---|
| 661,494 | 11/1900 | Clark et al. | 160/395 X |
| 3,126,332 | 3/1964 | Salete | 160/378 X |
| 3,255,556 | 6/1966 | D'Amato et al. | 52/81 |
| 3,273,633 | 9/1966 | Seidmon et al. | 160/395 X |
| 3,385,197 | 5/1968 | Greber | 98/58 |
| 3,530,621 | 9/1970 | Rutzebeck | 52/81 |
| 4,232,495 | 11/1980 | Tung-Yen Lin | 52/245 X |

FOREIGN PATENT DOCUMENTS

| | | | |
|---|---|---|---|
| 2416043 | 10/1975 | Fed. Rep. of Germany . | |
| 689211 | 5/1930 | France . | |
| 2325290 | 4/1977 | France . | |
| 363016 | 12/1931 | United Kingdom | 52/245 |

*Primary Examiner*—Alfred C. Perham
*Attorney, Agent, or Firm*—Fleit, Jacobson & Cohn

[57] ABSTRACT

A cooling tower or chimney comprises an assembly of rigid frames which form a trellis. The meshes defined by the trellis are covered by a casing in the form of a sheeting (not shown), which is recessed to a greater or lesser degree towards the inside of the tower in order to give to the tower a broken up external surface. The tower is constructed by the assembly of preassembled frames or groups of frames to which the sheeting has previously been attached, while on the ground.

15 Claims, 5 Drawing Figures

COOLING TOWERS

The present invention relates to a tower for use as a cooling tower and/or a chimney, and to a method of constructing same.

The invention is particularly concerned with the construction of towers intended for dry, wet, or semi wet cooling, which make it possible to lower the temperature of a heat carrying fluid by exchange with air and/or water, with or without utilising the latent heat of evaporation of the latter.

In the most widespread method of construction of cooling towers for industrial purposes, for example in electric power stations, the cooling towers are made up of reinforced concrete shells whose surface defines a contour similar to an element of a hyperboloid of revolution.

The size of these towers depends basically on the amount of energy to be extracted from the heat carrying fluid on the one hand, and on the type of cooling, (dry, semi wet, wet) on the other hand.

However, there is a maximum height limit of approximately 165 meters owing to the risk of the tower buckling under its own weight and as a result of wind action. Since a concrete shell is a structure which is both fixed and locally fragile, it is not possible, without reinforcing its cross section, to install or adapt a mobile system of correction for the effects of the wind. Hence as the output of a power station increases, it is necessary to have several towers operating in parallel, which take up a much greater area than one tower and require complicated connecting pipe work. In addition, such concrete shells have a considerable elevated mass which makes them very vulnerable in areas with strong earth movements.

Finally, the construction of these shells is delicate, long and costly since their high weight requires specific foundations from which posts are manufactured on site, these are generally tilted, formed in triangles and with circular cross section and their purpose is to establish in the lower part of the tower, from the ground level, an open part which makes the inlet of fresh air possible; the construction of the shell itself then begins, with the necessity of casting concrete at high altitudes for which the shuttering and removal of shuttering require great precautions to be taken and uses up specialised teams of workmen for long periods of time.

The object of the present invention is to provide a cooling tower of novel construction which eliminates or substantially mitigates the drawbacks mentioned above.

According to the present invention there is provided a tower for use as a cooling tower or a chimney comprising a trellis framework made up of a plurality of rigid bars and a casing which is attached to the framework in order to cover at least a part of the framework, characterised in that the framework is made up of a plurality of rigid frames which define an internal periphery forming a mesh, an external periphery in the form of a polygon by which the frames are juxtaposed, an interior face and an exterior face which faces are turned towards the inside and outside of the tower respectively, and in that means are provided for the assembly of each frame of the framework to at least one adjoining frame in a position in which a part of its external periphery which corresponds to one side of the said polygon is in contact with a similar part of the exterior periphery of the adjoining frame, the said means being situated along the said parts of the two frames so that the connecting parts of the two adjoining frames define a bar of the trellis the casing comprising a sheeting which is attached to the frames to cover the meshes in a position which, in relation to the exterior face of a frame, is recessed towards the interior face by a value which is between zero and the distance which separates the interior face from the exterior face inclusive, the said value being predetermined according to the degree with which it is desired to form a broken up external surface on the tower.

The tower according to the invention can be made with a considerably reduced weight as compared to a tower made from reinforced concrete of the conventional type described above, for towers of identical height, and with the result that the size of the foundations can be reduced and there is a corresponding lesser vulnerability to earth movement owing to the lesser mass.

The tower according to the invention also enables the construction, without exceptional equipment, of towers which greatly exceed the height of 165 meters, which is considered to be a maximum in the case of towers made from a reinforced concrete shell, with the advantage that a considerable reduction of the area taken up on the ground for cooling equipment can be made, since it is thus possible to fulfil greater requirements with one single tower.

This possibility of considerably increasing the height of the towers which the invention affords, also results from the fact that, in a tower according to the invention, the position of the casing can be varied with respect to the outer surface of the tower in order to present a broken up external surface to reduce the effects of the wind on the tower.

The broken up surface of a solid causes different distributions of pressures and suctions than that of a smooth solid and in the present case causes less stress to be applied to the walls of the tower.

It is also possible to omit the covering of certain selected meshes, whatever their level and their direction, to leave parts which open, or to fix movable casing which makes it possible to modify the air flow patterns of the wind and to make full use of the wind as a coolant.

One advantage of the present invention is that it permits prefabrication on the ground, not only of the framework, by constructing frames on the ground which are then assembled to form this framework, but also of the encased framework since it is possible to cover the frames on the ground, individually, if one sheeting per frame is provided, or by groups of frames pre-assembled on the ground if one sheeting is designed for being common to several frames.

Hence there is no need to hoist shuttering, which makes a very rapid construction possible. All the elements of the tower which is made in accordance with the invention remain of a weight which is compatible with lifting by several cranes of moderate power, each of which can be used to erect a particular portion of the tower so that the tower can be erected in any suitable manner as desired.

When the frames are covered with sheeting on the ground that is, when the frames are pre-assembled before assembly of the tower, inclement weather and especially the wind do not substantially affect the building times and costs of the tower itself.

It will be noted that to provide one sheeting per mesh or per group with a small number of meshes, makes it possible to carry out simple repair of a damaged sheeting, by simple replacement.

Finally, it will be noted that, when the tower must have an open base, made up of a number of spacing posts interposed between the tower itself, and the foundation, this base can be constructed with advantage from frames similar to those of the framework, except that they do not need to be cased. Each post can be formed by assembly, over the whole of their length, of parts of the frames which correspond to the sides of the polygon established by their exterior periphery. Naturally, the geometry of these frames is established as a function of their level in relation to the ground in the construction.

Generally speaking, the tower can be used as a cooling tower and/or chimney.

The present invention will now be described by way of example with reference to the accompanying drawings, in which.

Figure 1:
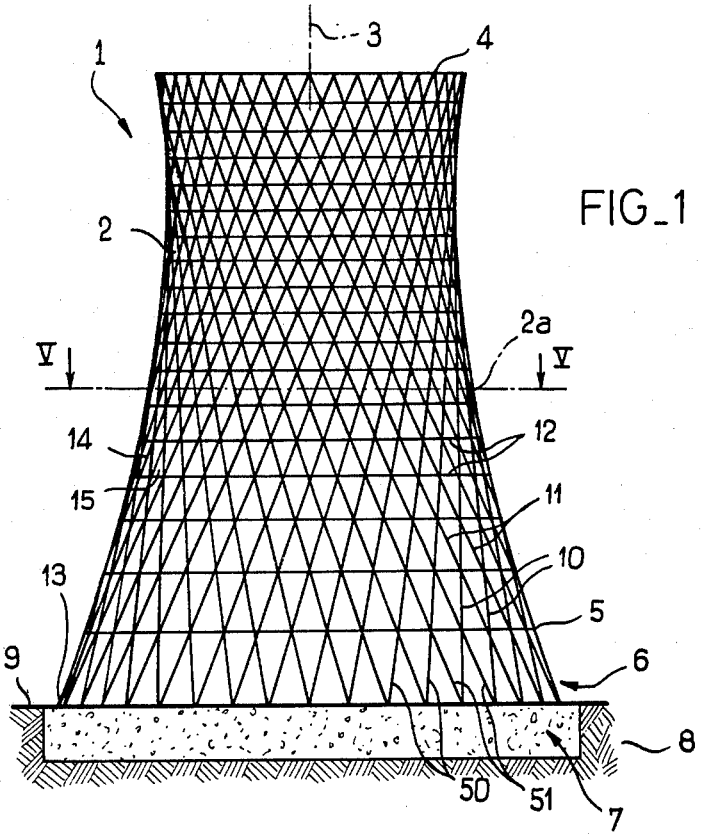
FIG. 1 shows a side elevation of a cooling tower constructed according to the invention.
Figure 2:
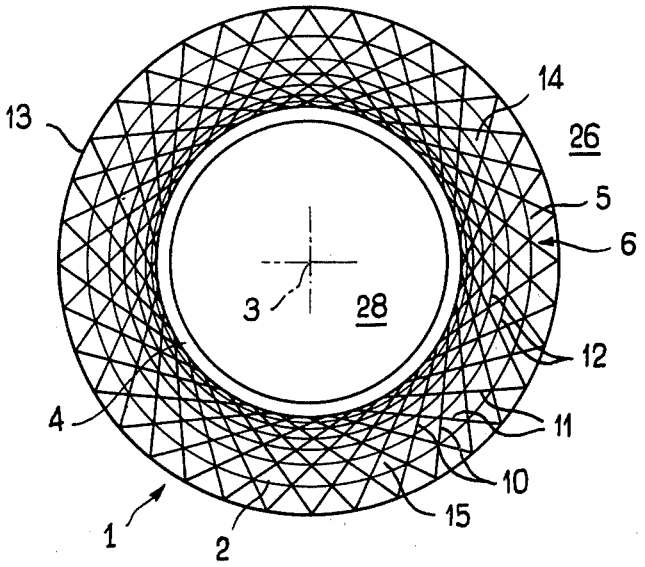
FIG. 2 is a plan view of the tower.
Figure 4:
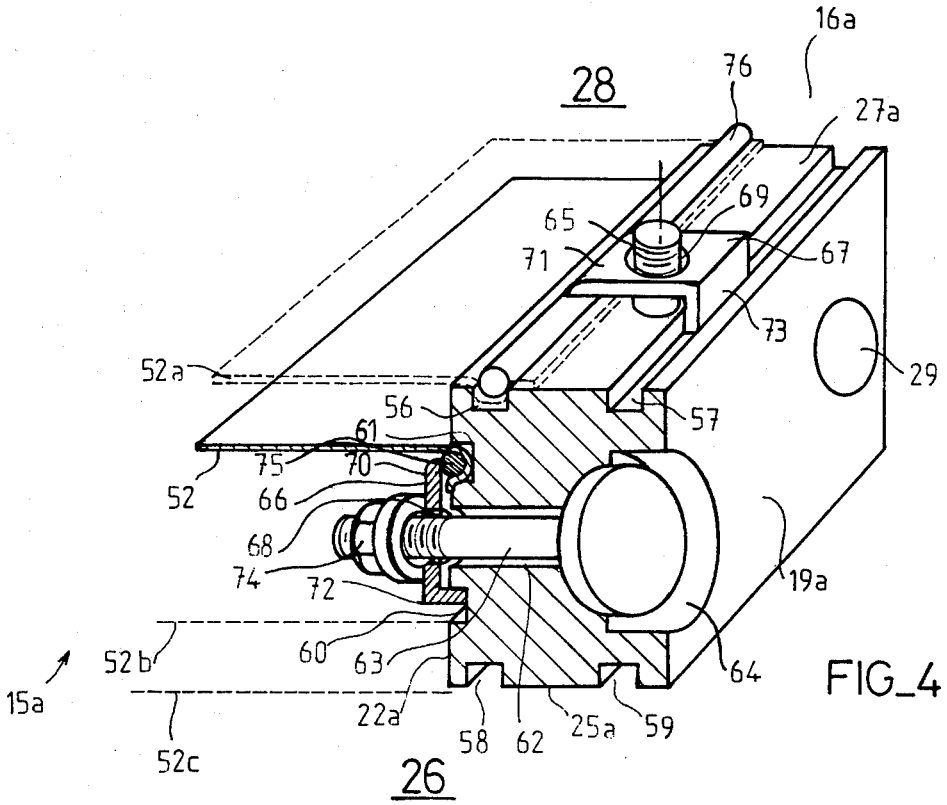
Figure 5:
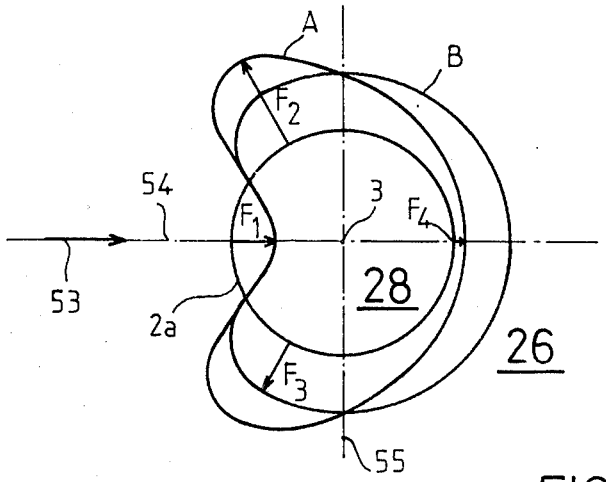

FIG. 4 illustrates an example of the method of fixing the covering on a framework of the tower, and shows to a greatly enlarged scale and in cross section, a portion of the tower; and FIG. 5 illustrates the distribution of forces which result owing to the action of a wind of a predetermined direction across any horizontal cross section of the wall of the tower, and for example in its cross section along the plane V—V as shown in FIG. 1.

Referring to the drawings, there is shown a tower 1 whose wall 2 has a surface contour similar to an element of a hyperboloid of revolution around a vertical axis 3. The wall 2, which is impermeable to liquids and gases, has an upper periphery 4 and a lower periphery 5.

The wall 2 of the tower 1 rests on the ground by means of an open work base 6, which is connected on the one hand to the lower periphery 5 of the tower 1, and on the other hand to foundations 7 which are sunken into the ground 8. Hence the lower periphery 5 of the wall 2 is situated horizontally at a level higher than that of the surface 9 of the ground 8. The base 6, whose construction will be described later, comprises a plurality of posts arranged inclined according to the same hyperboloid of revolution as the wall 2, and which are connected to the lower periphery 5 of the wall and to the foundations 7.

Generatrices of the hyperboloid surface of the tower and defining two sets are shown diagrammatically at 10 and 11. The generatrices 10 of one set intersect the generatrices 11 of the other set on parallels of the hyperboloid whereby intersections occur at parallels 12 defining, inter alia, the upper periphery 4 of the wall 2 and its lower periphery 5, the periphery 13 of the base 6 at the level of the surface 9 of the ground, and an intermediate parallel 12 between the parallels which define the upper periphery 4 and lower periphery 5 respectively.

Figure 3:
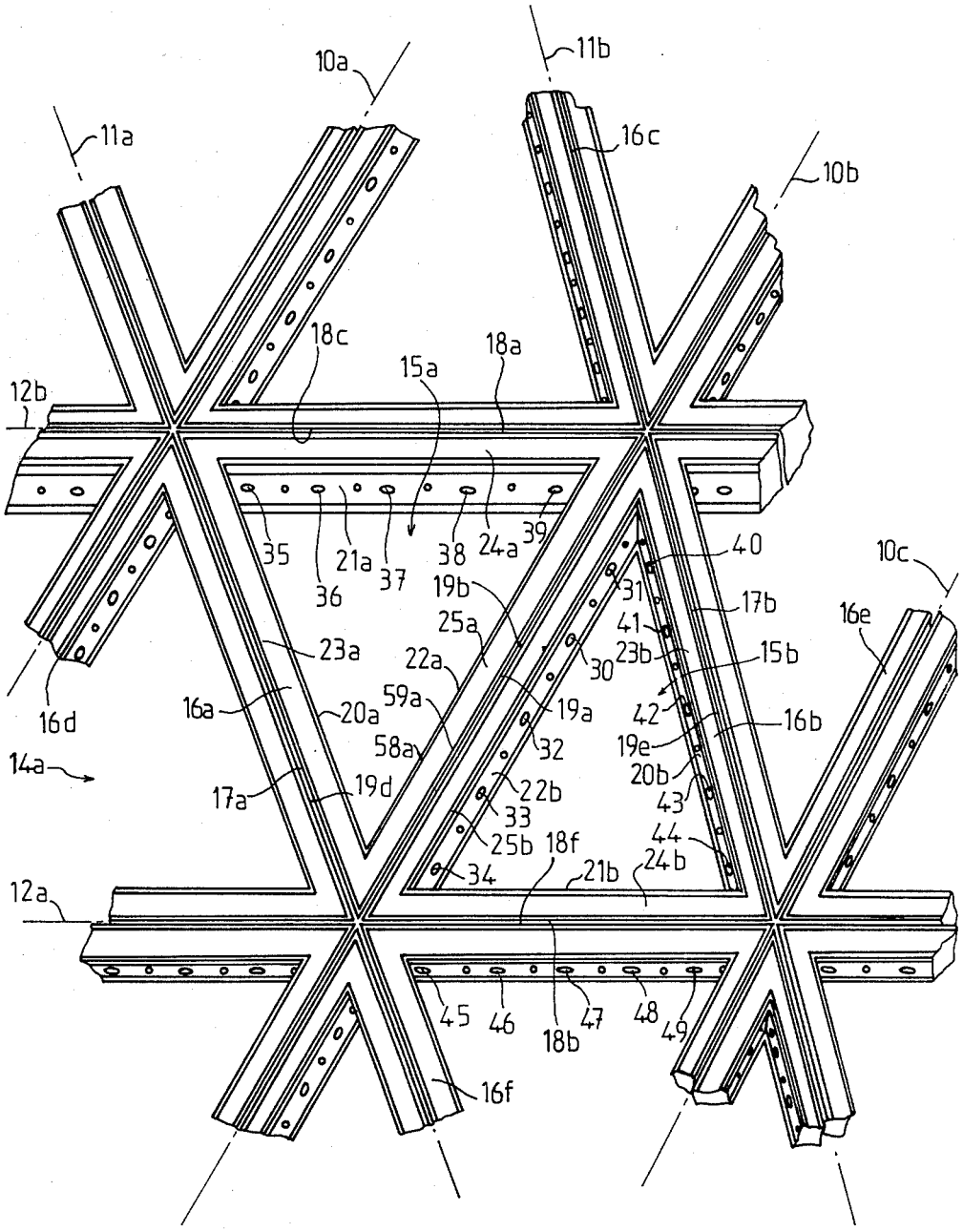
FIG. 3 is a greatly enlarged detail of FIG. 1, with a covering thereof omitted.

In the enlarged FIG. 3, are shown three generatrices 10*a*, 10*b*, 10*c* belonging to the set 10 of generatrices 10 and adjacent thereto two neighbouring generatrices 11*a* and 11*b* of the set 11 of generatrices together with two adjoining parallels 12*a* and 12*b* of the set of parallels 12. The generatrices 11*a* and 11*b* intersect the generatrices 10*b* and 10*c* respectively at the parallel 12*a* and the generatrices 10*a* and 10*b* respectively at the parallel 12*b*. It will be noted that the generatrices 10*a*, 10*b*, 10*c*, 11*a*, 11*b* and the parallels 12*a*, 12*b* have been chosen at random from their respective sets.

The tower comprises a load bearing framework in the form of a trellis of rigid bars which defines a plurality of meshes. Advantageously, when the profile of the tower defines a form of hyperboloid as in the illustrated example, the bars of the trellis are arranged according to the sets of generatrices 10 and 11 and the set of parallels 12, which together define meshes of a triangular shape. A zone 14 of the wall 2 which is situated between two adjacent parallels 12, as for example the zone 14*a* situated between the parallels 12*a* and 12*b* if we refer to FIG. 3, then presents itself in the form of a juxtaposition of meshes 15 each in the form of an isoceles triangle, whose base and apex are situated respectively on either of the two adjoining parallels 12*a*, 12*b*, and whose other two sides are defined by a generatrix 11 and a generatrix 10. The meshes arranged between two adjoining parallels 12 are thus juxtaposed top to bottom, by their sides adjoining their base, their apex opposite to this base being turned alternatively upwards and downwards.

It will be noted that the invention is not confined to towers whose meshes are of triangular shape, and that it would be possible to construct in the manner described towers whose meshes have another polygonal shape, for example, a hexagonal or trapezoidal shape.

The trellis of bars which defines the load bearing framework comprises an assembly of rigid frames each of which has an interior periphery which defines a mesh and an exterior periphery in the form of a polygon, by which the frames are juxtaposed in a position in which they present one surface towards the inside of the tower and one surface towards the outside of the tower.

In this example, the exterior periphery of each of the frames is approximately the same shape as the periphery of one of the meshes 15 as they have been described above.

Referring to FIG. 3 wherein two adjoining meshes are indicated by numerals 15*a* and 15*b* respectively and are juxtaposed top to bottom between the two parallels 12*a* and 12*b*, a frame 16*a* presents an exterior periphery 17*a*-18*a*-19*a* in the form of an isoceles triangle, the base 18*a* being situated along the parallel 12*b* and the two other sides of the triangle 17*a* and 19*a* intersecting on the other parallel 12*a*. A frame 16*b* presents an external periphery which is likewise triangular, which is established by a base 18*b* situated along the parallel 12*a* and by two sides of the same length 17*b* and 19*b* which intersect on the parallel 12*b*. The sides 17*a* and 17*b* are arranged along the generatrices 11*a* and 11*b*, respectively, and the two sides 19*a* and 19*b* are placed edge to edge along the parallel 10*b*.

The internal periphery of the frames also presents the shape of an isoceles triangle, whose sides are parallel to those of the external periphery. The internal periphery of the frames 16*a*, which defines the mesh 15*a*, presents three sides 20*a*, 21*a*, 22*a*, which are parallel to the sides 17*a*, 18*a*, 19*a* respectively, and the interior periphery of the frame 16*b* which defines the mesh 15*b*, presents three sides 20*b*, 21*b*, 22*b* which are parallel to the sides 17*b*, 18*b*, 19*b* respectively.

As shown in FIGS. 3 and 4, each of the frames presents respectively towards the inside and towards the outside of the tower a planar face which is defined by flat members which join respectively each side of the exterior periphery to the corresponding side of the interior periphery. FIG. 3 hence shows coplanar flat members 23*a*, 24*a*, 25*a* which join the sides 17*a*–20*a*, 18*a*–21*a*, 19*a*–22*a* respectively and which define the face of the frame 16*a*, which is turned towards the outside 26 of the tower, and three flat surfaces, which are coplanar among themselves 23*b*, 24*b*25*b*, which join the sides 17*b*–20*b*, 18*b*–21*b*, 19*b*–22*b* respectively establishing the face of the frame 16*b* which is also turned towards the outside of the tower. FIG. 4 shows one of the coplanar flat surfaces which defines the face of the frame 16*a*, which is turned towards the interior 28 of the tower, that is, the planar surface 27*a* joining the sides 19*a* and 22*a* parallel to the flat surface 25*a*, the faces of each frame turned respectively towards the interior 28 and towards the outside 26 of the tower being parallel to one another.

It can be seen in FIG. 4 that in the case of the frame 16*a*, as in the case of the other frames which define the framework of the wall 2, the sides of the frame which define the interior periphery of the latter, as for example, the side 22*a*, are defined by the planar surfaces which are directed appreciatively perpendicularly to the planar surfaces which define the faces of the frame which are turned towards the inside 28 and towards the outside 26 of the tower respectively, that is, in the case of the side 22*a* the planar surfaces 27*a* and 25*a*. The sides such as the side 19*a* forming the exterior periphery of the frame are for their part defined by planar surfaces directed obliquely in relation to the other planar surfaces, their direction in relation to these latter being chosen to be such that, when the frames are juxtaposed and assembled by their sides which define their respective external periphery, as for example the sides 19*a* and 19*b* in the case of the frames 16*a* and 16*b*, the planar surfaces which define these sides are in contact over a maximum area of their surface and preferably over the whole of the latter, in order to define the load-bearing framework of the wall 2 of the tower 1. The juxtaposition of the faces of the frames turned towards the inside 28 and the outside 26 respectively of the tower define the general shape of the wall 2 of this tower, that is, a shape close to an element of hyperboloid of revolution about the axis 3. A cross section of FIG. 4, through a plane perpendicular to the planar surfaces 22*a*, 25*a*, 27*a* and 19*a*, hence shows the cross section in the form of a rectangular trapezium defined by the flat surfaces.

The assembly of the frames to form the tower is carried out preferably by joining the frames together over the whole of the length of the juxtaposed sides. It can be carried out, for example, by casting a connecting material between the adjoining sides of the adjoining frames, such as 19*a* and 19*b*, it being possible to provide anchoring reliefs of the material cast in this manner on the respective exterior peripheries of the different frames. One could also have recourse to gluing, welding, nailing, pinning, keying and, as in the present example, bolting, preferably by high resistance bolting.

In order to permit a bolting of this kind, the frames are provided along each of the sides of their exterior periphery with holes which are cross orientated perpendicularly to the planar surfaces defining said sides approximately half way from the faces of the frames which are turned respectively towards the inside and outside of the tower. FIG. 4 shows one of these holes 29, arranged perpendicularly to the flat surface 19*a* approximately half way between the two flat surfaces 25*a* and 27*a*. When the frames 16*a* and 16*b* are juxtaposed by their sides 19*a* and 19*b*, this hole 29 is placed facing a similar hole drilled perpendicularly to the planar surface which defines the side 19*b* of the exterior periphery of the frames 16*b*. The two holes placed in this manner facing one another receive a bolt such as 30, whose head is supported for example, on the planar surface which defines the side 22*b* of the interior periphery of the frame 16*b*, and a complementary nut (not shown) on the flat surface 22*a* defining one of the sides of the interior periphery of the frame 16*a*, an element such as a washer being inserted to increase the support surface and/or prevent the nut from becoming loose.

As shown in FIG. 3, an assembly of this kind between frames 16*a* and 16*b* is repeated at several points distributed along their contiguous sides 19*a*–19*b*, the corresponding bolts being designated by the references 31–34 respectively. The parts of the two frames joined in this manner, that is, the part of the frame 16*a* defined by the planar surfaces 19*a*, 22*a*, 25*a*, 27*a* and the similar part of the frame 16*b* defined by the planar surfaces 19*b*, 22*b*, 25*b*, form an integral whole which forms a section of the bar of the framework trellis which is orientated following the generatrix 10*b*.

An assembly of this kind is found distributed along each of the adjoining respective parts of two adjoining frames, and for example, if we refer to FIG. 3, at 35 to 39 along the side 18*a* of the frame 16*a* for assembling the latter to a similar frame 16*c* situated immediately above it and whose side 18*c* corresponding to the side 18*a* is super-posed on the latter along the parallel 12*b*. Such an assembly is also found repeated on adjacent sides 17*a* of the frame 16*a* and 19*d* of a similar frame 16*d* situated like it between the parallels 12*a* and 12*b* and juxtaposed top to bottom against the frame 16*a*. This frame 16*d* is identical to the frame 16*b*, at 40, 41, 42, 43, 44 to the connection between the sides 17*b* of the frame 16*b* and the immediately adjoining side 19*e* of a frame 16*e* identical to the frame 16*a* and juxtaposed like it top to bottom to the frame 16*b*, and at 45, 46, 47, 48, 49 to the connection, along the parallel 12*a*, between the side 18*b* of the frame 16*b* and the similar side, immediately adjoining, 18*f* of the frame 16*f* which is situated immediately below the frame 16*b*.

The integration of the frames around the whole of their periphery also ensures the integration of the different sections of bars of the framework situated following the same parallel or following the same generatrices respectively which correspond respectively to the bases of the isoceles triangles and to the other sides of these triangles in the case of the example illustrated. The assembly of the frames presents the mechanical characteristics of a bar trellis whilst offering a convenience of construction as the tower can be built up of modules formed by these frames. Assembly is, therefore easier than known methods used hitherto.

It will be noted that the frames situated between two parallels belong, at the most, in the example illustrated, to two different types, corresponding respectively to the case in which the base is turned towards the top and the case in which it is turned towards the bottom, and even possibly to one single type, which makes it possible to construct frames, when concrete or any other mouldable material is chosen as a constituent material, by means of a reduced range of moulds; naturally each frame is preferably moulded as a single element.

The frames immediately joining the upper periphery 4 of the wall 2 of the tower 1 can advantageously accommodate a crown (not shown) of similar form to the tower.

The frames adjacent to the lower periphery 5 of the walls 2 are for their part advantageously assembled, in a similar manner to the similar frames which form the open base 6, which frames are assembled in the same manner as the frames of the framework of the wall 2, with the foundations 7 at the level of the periphery on the ground 13 of the tower. These frames of the base 6 are similar in every respect, except for their dimensions, to the frames of the carrying framework of the wall 2, and the frames of the framework at the level of the lower periphery 5, and they will be referred to hereinafter with the same reference numerals mentioned above for the frames of the framework 16*a* to 16*f*.

It will be noted that the construction of the base 6 by assembly of frames as described above which form posts 50 directed following the generatrices 10 and posts 51 directed following the generatrices 11, is much more convenient and rapid than a construction of bars on site, which is usually used. The frames of the base are prefabricated on the ground, in the works or in the vicinity of the site of the tower which is being constructed, in order to be assembled once they have acquired the correct rigidity so that it is not necessary to have recourse to shuttering or other devices for temporary stiffening.

Except for their dimensions, the base frames differ from the framework frames only in the absence of the casing.

The base frame 6 remains open, whilst the frames of the framework have a casing made from a sheeting material, for example a synthetic textile canvas coated with an impermeable protective material, in order to form the impermeable wall 2 of the tower 1.

This casing is shown in FIG. 4 in the case of a frame 16*a* and is omitted from FIG. 3 for reasons of clarity of the drawing. The casing is designated by the reference number 52.

This casing, which is attached to one frame or a group of frames on the ground before assembly of the frames or groups of frames, is arranged in relation to the frame in such a manner as to obtain a specific broken up effect of the wall 2 of the tower towards the exterior 26 of the latter.

A broken up surface of this kind is in fact desirable in order to reduce the stresses which appear under the action of the wind on the wall 2, that is, in the framework formed by the assembled frames.

FIG. 5 shows in a diagrammatic manner two curves A and B which indicate the intensity of the normal stresses applied to a section 2*a* of the wall 2 on a horizontal plane, which is perpendicular to the axis 3, under the influence of a wind which is shown diagrammatically by an arrow 53, directed perpendicularly to the axis 3. The line 2*a* which diagrammatically represents the cross section of the wall 2 indicates a zero level of the stress and the value of the stress at any point of the cross section 2*a* being read from this origin following a radial direction in relation to the axis 3 and passing through the point on curve A or B. The forces which are read starting from the origin represented by the line 2*a* towards the axis 3 are compressive stresses, and the forces which are read starting from the origin in the direction which goes away to a distance in relation to the axis 3 are suction forces.

The curve A corresponds to the case of a smooth tower and the curve B to the case of a tower whose surface is broken up on the exterior 26. It can be seen that the occurrence of a wind in the direction of the arrow 53 is expressed as a compressive stress in an area of the cross section 2*a* which is facing the wind, symmetrically either side of a plane 54 respectively including the axis 3 and directed parallel to the direction of the wind, the maximum point F1 of this compressive stress, measured in the plane 54, approximately coinciding in the case of the tower which has a broken up surface and a smooth surface. The area of the section 2*a* which is thus subjected to compressive stresses displays an angular development, brought back to the axis 3, which is variable but less than 180°, and even 90° in the example shown, and the rest of section 2*a* is subjected to suction forces whose maximum, F2 as far as curve A is concerned and F3 as far as curve B is concerned, is situated on the same side of a plane 55, perpendicular to the plane 54 and including the axis 3, as the area subjected to a compression.

It appears that the maximum suction force F3 undergone by a tower with a broken up surface, of a similar intensity to that of the force F1, is weaker than the maximum suction force F2 which is undergone by a smooth tower, in a ratio which may be of the order of 1/1.6, this figure being given as a non limiting example. Consequently the risks of buckling of the tower under the action of the actual weight of the wind are much less in the case of a tower with a broken up surface than in the case of a smooth tower. This reduction is all the more apparent in that in the case of a tower with a broken up surface, the suction forces retain a value which is close to their maximum F3 on the greater part of the section 2*a*, whilst they experience a minimum F4 which is very much less than F2 in the zone of the tower which is diametrically opposite to the zone of maximum compression force F1 in the case of the smooth tower. In other words, the amplitude of variation of the forces to which a lateral cross section 2*a* of the wall 2 of the tower is subjected is much greater in the case of a smooth tower than in the case of a tower with a broken up surface, the result of which is that the stresses are distributed much better in the wall of the latter than in the wall of a smooth tower.

Naturally, this amplitude, as well as the respective maximum of the compression and suction forces respectively, and the stresses which result from these in the wall of the tower are closely related to the intensity of the wind. In order to take this intensity into account when it is planned to construct a tower, the existence of possible prevailing winds, that is, a wind of maximum intensity from one or several specific directions should be determined. The invention proposes to modify the broken up surface of the tower from one tower to another and/or according to the areas of the wall of one same tower, in order to obtain a predetermined distribution and maximum intensity of the compression and suction forces which are likely to occur in this wall, by modifying the position of the casing in relation to the surface of the frame which is turned towards the exterior 26 of the tower.

FIG. 4 shows an example of a means of integrating of a casing sheeting with the corresponding frame in a particular preferred case in which the casing of each frame, that is, of each mesh of the trellis, is independent of the casing of the other meshes and consists of a sheeting which belongs to this particular mesh. Such a choice makes it possible to cover the frames on the ground before assembling them, which limits the operations which have to be carried out at a distance from the ground to the assembly of the frames which have been previously covered.

It will be noted that the means of integration shown and which now will be described, are a non limiting example, and that any other method of integration which ensures a hermetic connection between the sheeting and the frame and preferably, but not exclusively, a tension of the sheeting within the frame, could be chosen without departing from the scope of the invention.

In the example shown, the casing occurs on each of the flat surfaces of a frame which establish respectively the face of the frame which is turned towards the interior 28 of the tower and the face of the frame turned towards the exterior 26 of the latter. On each of the planar surfaces which define the interior periphery of the frame, over the whole length of these planar surfaces, sets of two grooves are formed which are parallel to one another and parallel to the joining ribs between these planar pieces.

Hence if we refer to FIG. 4, the flat surface 27*a* has a set of two identical parallel grooves 56 and 57, which are situated parallel to the joining ridges of the planar surfaces 27*a* with the planar surfaces 19*a* and 22*a* practically over the whole of the length of the flat surface 27*a*. The planar surface 25*a* in its turn has a set of two grooves 58 and 59, which are both identical to the grooves 56 and 57, and which are parallel to one another and to the connecting ridges of the planar surface 25*a* with the planar surfaces 19*a* and 22*a*, and situated at a distance from one another which is equal to the distance which separates the grooves 56 and 57. Similarly, the planar surface 22*a* has a set of two grooves 60 and 61 which are identical to the grooves 56 and 57, which are parallel to one another and situated at a relative distance which is identical to the distance which separates the grooves 56 and 57. With the exception of the flat surfaces 17*a*, 18*a*, 19*a*, 17*b*, 18*b*, 19*b* whose purpose is to be joined side by side to similar flat pieces of other frames, each of the flat surfaces of a frame has such sets of two grooves, which are shown diagrammatically by a simple line in FIG. 3.

Half way between the two grooves of each set there are provided, at several points of their length, holes which cross the frame perpendicularly to the corresponding flat surface, such as the hole 62 which crosses the frame either side perpendicularly to the flat surface 22*a*, at mid distance between the grooves 60 and 61, in order to accommodate the stem of a bolt such as 63. The head of the bolt 63 is supported on the frame, on the side of the planar surface 19*a* of the latter, in a seating such as 64 which is provided for this purpose in order to prevent projection in relation to the flat surface 19*a*, or pins such as 65 which are integral with the frame and directed perpendicularly to the corresponding flat surface, in this case 27*a*.

On a part of the stem of the bolt 63 which projects in relation to the planar surface 22*a*, and on the part of the pin 65 which projects in relation to the planar surface 27*a*, and on a possible similar element provided in a projecting manner in relation to the flat surface 25*a* quadrant plates 66 can be fitted each of which quadrant plates 66 has holes 68, 69 which traverse planar areas 70 or 71 respectively of the plates. These areas 70, 71 are located parallel to the planar surface 22*a* or the planar surface 27*a* respectively. The dimensions of the areas 70, 71 being such that in such a position, they have an edge against each of the grooves of the corresponding planar surface, 61 and 60 respectively in the case of the quadrant plate 66, and 56 and 57 in the case of the quadrant plate 67. One of these edges, which is situated facing the groove 60 which is nearest to the planar surface 25*a* in the case of the quadrant plate 66, or facing the groove 57, which is nearest to the flat surface 19*a* in the case of the quadrant plate 67, presents a rectangular edge 72 or 73 respectively, which penetrates into the groove. The depth of this groove measured perpendicularly to the corresponding planar surface is less than the dimension which the edge presents perpendicularly to the other part 70 or 71 respectively, of the quadrant plate in such a manner that the screwing of a nut 74 onto the stem of the bolt 63, or of a similar bolt which is not shown on the pin 65, on the side of the face of the part 70 or 71, respectively of the quadrant plate opposite its face turned towards the corresponding flat surface of the frame, would tend to cause the edge of the part 70 or 71 of the quadrant plate opposite to its edge which carried the edge 72 or 73 to move towards the throat 61 or 56. This makes it possible to engage under pressure, in the throat 61 or the throat 56 respectively, a strip, 75 or 76 respectively, which, if a peripheral area of the sheeting 52 or 76 has been inserted previously between it and the corresponding throat, this peripheral zone is immobilised, in a hermetic manner, if necessary in a require state of tension in relation to the frame such as 16*a* in the example shown.

It will be noted that the described arrangements make it possible not only to install sheeting 52*a* to the right of the face of the frame which is turned towards the inside 28 of the tower, which obtains a maximum broken up surface since the distance separating the sheeting 52*a* from the face of the frame which is turned towards the outside 26 of the tower is at a maximum, or sheeting 52 at an intermediate distance between this maximum distance and half of this maximum distance, but also, by turning the quadrant plate such as 66 in such a manner as to engage its flange 72 into the throat 61 in order to engage the strip such as 75 under pressure into the throat 60 with insertion of a peripheral area of the sheeting between the strip and the bottom of the throat, to fix this sheeting in a position where it is situated at a distance from the face of the frames whose purpose is to be turned towards the outside 26 of the tower which is intermediate between the zero value and half of the maximum distance. This position is shown at 52*b*, or again in a position shown at 52*c* in which, since quadrant plates such as 66 and 67 and a strip such as 75 or 76 are used in coordination with the grooves 56 and 59, the sheeting is flush with the face of the frame which is turned towards the outside 26 of the tower. A same sheeting can thus be positioned differently. The same frame thus gives access to four positions of the sheeting in relation to the face of a frame which is turned towards the outside of the tower, that is, four possibilities of different reactions to the wind outside the tower.

Other means of integrating the sheeting with the periphery of the corresponding frame could naturally be used without going outside the scope of the invention, offering a greater or lesser number of possibilities of relative positioning of the sheeting and the frame.

Naturally, in the example shown, the strips such as 75 and 76 are extended over the whole of the length of the grooves in which they are intended to be engaged with insertion of a peripheral area of the sheeting, and quadrant plates such as 66 and 67 are arranged at several points distributed over the length of these strips to ensure a satisfactory fixing of the sheeting, over the whole of its periphery, with the corresponding frame.

In a variant which is not shown, one area of sheeting can be used to cover a group of frames, it being possible to fix the sheeting to the frames in the manner described at the level of the periphery of this sheeting, corresponding to the periphery of the group of frames. It would also be possible to attach points of the central portion of the sheeting to the frames of the group, for example to the corners of the frames, that is to the angles of the polygon formed by the external periphery of these frames. A hermetic contact between the sheeting and the frames of the group to which it corresponds can then be ensured exclusively at the common periphery of the sheeting and of this group of frames.

Whether sheeting is attached to one frame or to a group of frames, it is possible to fix the sheeting on the frames after interconnection of the latter. However, in both cases it is preferable to construct the frames on the ground, if need be to assemble the frames of a group, to attach the sheeting to each frame or group of frames in the manner described above, and then to hoist the frame or group of frames covered with sheeting in this manner into its final position in the tower.

However, in the case of a small tower, it is also possible to attach the sheeting to the frames after these have been constructed to make a framework for the tower. A single sheeting can be used to cover the whole tower.

In all cases, when an open base such as 6 must be provided, this base is constructed previously by assembly of the base frames which are connected to the foundations, in the manner described above, in order subsequently to enable the frames either individually or in groups to be assembled thereto whether these have previously had the sheeting fitted or not.

What is claimed is:

1. A tower for use as a cooling tower or a chimney comprising:

a plurality of rigid frames which are interconnected to form a trellis framework and which frames each define an internal periphery forming a mesh, an external periphery in the form of a polygon by which the frames are juxtaposed, an interior face and an exterior face, which faces are turned towards the inside and outside of the tower respectively;

means for assembling each frame of the framework to at least one adjoining frame in a position in which a part of the external periphery of the frame which corresponds to substantially the entire length of one side of the said polygon is in contact with a part of the exterior periphery of an adjoining frame, said means for assembling being situated along said parts of the adjoining frames so that connected parts of the two adjoining frames define a bar of the trellis framework; and casing means attached to the framework for covering at least a part thereof, which casing means comprises sheeting, and means for attaching the sheeting to the frames to cover the meshes so that the position of the sheeting, in relation to the exterior face of a frame, is recessed towards the interior face by a value which is selectively adjustable between zero and the distance which separates the interior face from the exterior face inclusive, the said value being predetermined according to the degree with which it is desired to form a broken up external surface on the tower.

2. A tower as claimed in claim 1, comprising foundations and a base connecting the tower to the foundations, the base itself comprising a plurality of spaced posts which are located between the tower and the foundations, which posts are made up of a plurality of rigid frames which define an internal periphery forming a mesh and an external periphery in the form of a polygon and which are interconnected one to another in positions in which part of the exterior periphery of each frame which corresponds to one side of the said polygon, is in contact with a similar part of the exterior periphery of an adjoining frame of the base or of an adjoining frame of the tower framework, and means for attaching said frames together along the said parts of the two frames so that the interconnected parts of the two adjoining frames form a post.

3. A tower as claimed in claim 1, wherein said means for attaching the sheeting to the frames enables attaching the sheeting to the frames in a stretched condition.

4. A tower as claimed in claim 1, in which the said polygons are isoceles triangles and the frames are juxtaposed top to bottom.

5. A tower as claimed in claim 4, wherein the outer surface contour of the tower defines the shape of an element of hyperboloid of revolution about a vertical axis, the bases of the triangles being arranged along parallels of the hyperboloids and their other sides being arranged along straight generatrices of this hyperboloid.

6. A tower as claimed in claim 1, in which each mesh is covered by a separate area of sheeting which has a periphery attached to the frame which defines said mesh, said means for attaching the said sheeting to said frame providing for the hermetic connection of the periphery of the sheeting and the frame around the whole periphery.

7. A tower as claimed in claim 1, in which a group of meshes is covered by a separate area of sheeting which has a periphery attached to the frames which define the said meshes said, means for attaching the said sheeting with the frame providing for the hermetic connection of the periphery of the sheeting and the periphery of the frames around the whole of this periphery.

8. A tower as claimed in claim 7, in which the means for attaching includes means for the point attachment of areas of the sheeting situated within the periphery of the latter to the frames of the group.

9. A tower as claimed in claim 8, in which the said point attachments take place at corners of the polygons formed by the frames.

10. A tower according to claim 1, wherein the contacting surfaces of the frames are planar surfaces forming oblique angles with respect to the interior faces of the frames, the angle of one contacting surface being complementary to that of the other contacting surface.

11. A tower according to claim 1, wherein the amount of recess of the sheeting varies throughout the height of the tower so that the tower has a broken up exterior surface.

12. A method of constructing a tower for use as a cooling tower or a chimney, said tower having a plurality of rigid frames interconnected to each other to form a trellis framework, each frame having an internal periphery defining a mesh and an external periphery in the form of a polygon connected to the external peripheries of adjacent frames, and separate areas of sheeting attached to the frames so that at least a portion of the framework is covered by sheeting, said method comprising:

attaching a separate area of sheeting to the periphery of an individual frame to thereby cover the mesh of the frame prior to interconnecting the frame to adjacent frames; and interconnecting the individual frame covered with sheeting to adjacent frames to thereby progressively construct the tower, said method further comprising attaching the sheeting to the individual frames in such manner that the distances between separate areas of sheeting and an exterior face of the tower vary between a zero value and a value equal to the distance separating an interior face from the exterior face of the tower so that the tower constructed from the frames has a broken up exterior surface.

13. A method as claimed in claim 12, in which foundations and a base are provided for the tower, the base comprising a plurality of spaced posts that are interconnected between the foundations and the tower, the posts being defined by a plurality of rigid base frames which define an interior periphery forming a mesh and an exterior periphery in the form of a polygon, said method further comprising:

connecting each base frame to at least one adjoining base frame in a position in which part of the exterior periphery of the base frame corresponding to a side of the said polygon is in contact with a part of the exterior periphery of an adjoining base frame so that the interconnected parts of two adjoining frames define one of the posts, and positioning said base frames so that they are juxtaposed and interconnected with the foundations by their periphery.

14. A method of constructing a tower for use as a cooling tower or a chimney, said tower having a plurality of rigid frames interconnected to each other to form a trellis framework, each frame having an internal periphery defining a mesh and an external periphery in the form of a polygon connected to the external peripheries of adjacent frames, and separate areas of sheeting attached to the frames so that at least a portion of the framework is covered by sheeting, said method comprising:

interconnecting a plurality of frames to each other to form a section of the tower;

attaching a separate area of sheeting to the periphery of the section of the tower to thereby cover the meshes of the frames forming the section; and interconnecting the section covered with sheeting to other sections to thereby progressively construct the tower, said method further comprising attaching the separate areas of sheeting to the separate sections in such manner that the distances between separate areas of sheeting and an exterior face of the tower vary between a zero value and a value equal to the distance separating an interior face from the exterior face of the tower so that the tower constructed from the frames has a broken up exterior surface.

15. A method as claimed in claim 14, in which foundations and a base are provided for the tower and which base comprises a plurality of spaced posts, that are interconnected between the tower and the foundations, the posts being defined by a plurality of rigid frames which define an interior periphery forming a mesh and an exterior periphery in the form of a polygon, said method comprising:

connecting each base frame to at least one adjoining base frame in a position in which part of the exterior periphery of the base frame, corresponding to one side of the said polygon, is in contact with a part of the exterior periphery of an adjoining frame so that the connected parts from two of the adjoining frames define one of the posts; and positioning said base frames so that they are juxtaposed and interconnected with the foundations by their periphery.

* * * * *